US005512731A

United States Patent [19]

McWilliams

[11] Patent Number: 5,512,731

[45] Date of Patent: Apr. 30, 1996

[54] RADIANT ELECTRIC HEATER

[75] Inventor: Joseph A. McWilliams, Droitwich, United Kingdom

[73] Assignee: Ceramaspeed Limited, United Kingdom

[21] Appl. No.: 192,984

[22] Filed: Feb. 8, 1994

[30] Foreign Application Priority Data

Feb. 11, 1993 [GB] United Kingdom ..... 9302691

[51] Int. Cl.[6] ..... H05B 3/68

[52] U.S. Cl. ..... 219/467; 219/457; 219/458; 219/459; 219/460; 219/463; 219/464; 219/465; 219/468

[58] Field of Search ..... 219/457, 458, 219/459, 460, 463, 464, 465, 467, 468

[56] References Cited

U.S. PATENT DOCUMENTS

| | | | |
|---|---|---|---|
| 600,057 | 3/1898 | Ball | 219/464 |
| 1,399,428 | 12/1921 | Hughes | 219/464 |
| 3,345,498 | 10/1967 | Siegla | 219/464 |
| 3,501,621 | 3/1970 | Pansing | 219/464 |
| 3,612,828 | 10/1971 | Siegla | 219/464 |
| 3,991,298 | 11/1976 | Maake | 219/464 |
| 4,292,504 | 9/1981 | Gebarowski | 219/542 |
| 4,713,527 | 12/1987 | Kicherer | 219/467 |
| 4,810,857 | 3/1989 | Goessler | 219/467 |

FOREIGN PATENT DOCUMENTS 261525 11/1926 United Kingdom .

*Primary Examiner*—Teresa J. Walberg
*Assistant Examiner*—Sam Paik
*Attorney, Agent, or Firm*—Ira S. Dorman

[57] ABSTRACT

A radiant electric heater is made by providing a base of microporous thermal and electrical insulation material having formed in a surface thereof at least one groove. The groove includes transverse webs of the microporous insulation material spaced apart along the length of the groove. An elongate electrically conductive strip is provided to serve as a heating element and is located edgewise into the groove and is urged into the webs so as to embed and secure the conductive strip in the webs.

9 Claims, 4 Drawing Sheets

FIG 5
A–A
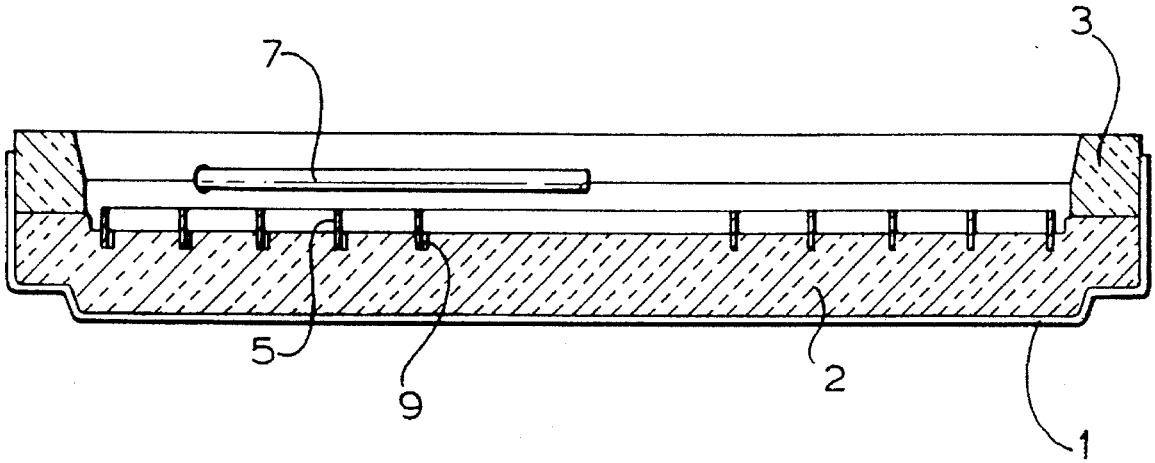
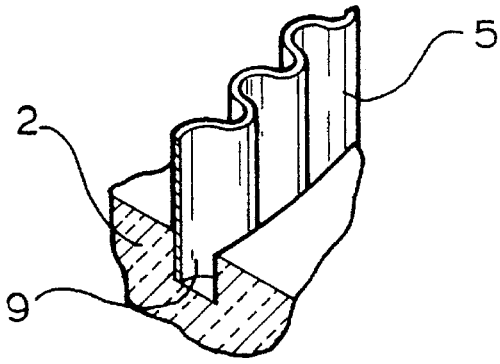
FIG 6

RADIANT ELECTRIC HEATER

This invention relates to a radiant electric heater for a cooker and, more particularly but not exclusively, relates to a radiant electric heater for use with glass-ceramic smooth top cookers. The invention also relates to a method of manufacturing such a radiant electric heater.

BACKGROUND TO THE INVENTION

Radiant electric heaters are known in which an element of coiled bare electric resistance wire is supported on, and secured by staples to, a layer of microporous thermal and electrical insulating material compacted in a metal support dish. Such heaters are described, for example, in GB-A-1 580 909 and are incorporated in glass-ceramic smooth top cookers.

The term microporous' is used herein to identify porous or cellular materials in which the ultimate size of the cells or voids is less than the mean free path of an air molecule at NTP, i.e. of the order of 100 nm or smaller. A material which is microporous in this sense will exhibit very low transfer of heat by air conduction (that is collisions between air molecules). Such microporous materials include aerogel, which is a gel in which the liquid phase has been replaced by a gaseous phase in such a way as to avoid the shrinkage which would occur if the gel were dried directly from a liquid. A substantially identical structure can be obtained by controlled precipitation from solution, the temperature and pH being controlled during precipitation to obtain an open lattice precipitate. Other equivalent open lattice structures include pyrogenic (fumed) and electro-thermal types in which a substantial proportion of the particles have an ultimate particle size less than 100 nm. Any of these particulate materials, based for example on silica, alumina or other metal oxides, may be used to prepare a composition which is microporous as defined above.

The microporous insulation typically comprises a dry particulate microporous material as defined hereinabove mixed with ceramic fibre reinforcement, titanium dioxide opacifier and, for high-temperature use, a small quantity of alumina powder to resist shrinkage. Such insulation material is described in GB-A-1 580 909.

Radiant electric heaters have also been proposed in which, instead of an element of coiled resistance wire, an element comprising an elongate electrically conductive strip of a metal or metal alloy is provided, the element being supported on edge on an insulating base. Arrangements of this kind are described, for example, in U.S. Pat. No. 600,057, U.S. Pat. No. 3,612,829, U.S. Pat. No. 3,991,298, U.S. Pat. No. 4,161,648 and U.S. Pat. No. 4,292,504. In U.S. Pat. No. 600,057, a conductor is mounted on a metal support, or in a groove formed therein, by means of a coating of insulating material such as a vitreous enamel. In U.S. Pat. No. 3,612,829, a convoluted conductive strip element in the form of a spiral is located in recesses pre-formed in the surface of a cast or moulded fibrous ceramic refractory material. Staples are used to secure the strip element to the supporting base. In U.S. Pat. No. 3,991,298, the conductive strip element is in the form of a spiral and is loose fitted in a pre-formed spiral groove in a rigid base of fire-resistant mortar.

In U.S. Pat. No. 4,161,648, a convoluted strip element of spiral form is provided with integral downwardly-extending mounting tabs which penetrate an electrically insulating sheet of high-temperature-withstanding board material. In the case of a thin sheet of board material, the mounting tabs are bent over at the back of the material. The board-like insulating sheet with the element thereon is then located on top of a layer of microporous thermal insulation material in a supporting dish. In the case of a thick sheet of board material, a hardenable substance is used and is hardened after the tabs have been urged into the material.

In U.S. Pat. No. 4,292,504, a heating element in the form of a thin, foil-like strip of expanded metal is supported on edge substantially along its entire length in a serpentine groove formed in the upper surface of a ceramic fibreboard. The heating element is cemented or held by friction in the groove formed in the board.

In these known constructions, when the heating element is secured in a base a two-stage fixing process is required, such as insertion and subsequent stapling, bending over of tabs or cementing, or insertion and hardening of the base.

OBJECT OF THE INVENTION

It is an object of the present invention to provide a radiant heater and a method of manufacturing such a radiant heater in which an elongate electrically conductive strip heater element is secured directly to a base of thermal and electrical insulation material without the need for mounting tabs or staples or any other additional securing means or process.

SUMMARY OF THE INVENTION

According to one aspect of the present invention there is provided a radiant electric heater comprising a base of microporous thermal and electrical insulation material having a surface with at least one groove formed therein, into which groove is located edgewise an elongate electrically conductive strip of predetermined height to serve as a heating element, the groove including transverse webs of the microporous insulation material spaced apart along the length of the groove and into which webs is embedded the conductive strip so as to secure the conductive strip to the webs.

According to another aspect of the present invention there is provided a method of manufacturing a radiant electric heater comprising the steps of: providing a base of microporous thermal and electrical insulation material having formed in a surface thereof at least one groove, the groove including transverse webs of the microporous insulation material spaced apart along the length of the groove; providing an elongate electrically conductive strip of predetermined height to serve as a heating element; and locating the elongate electrically conductive strip edgewise into the groove and urging the strip into the webs so as to embed and secure the conductive strip in the webs.

By means of the invention, the electrically conductive strip is positively located by the groove(s) and securely fixed by embedding in the webs.

Surprisingly, in view of the nature of the microporous insulation material, the strip remains securely located during subsequent operation of the heater.

The webs may be substantially coplanar with or below that surface of the base in which the groove is provided. The located conductive strip may protrude from the webs in the base of microporous insulation material such that the strip is not embedded to its full height in the webs.

Preferably the electrically conductive strip is of corrugated (also know as sinuous, serpentine or convoluted) form along its length.

The base of microporous insulation material is suitably provided as a compacted layer inside a supporting dish, suitably of metal.

The base of microporous insulation material preferably has a surface of substantially planar form in which the groove is provided.

The strip may comprise a metal, or a metal alloy such as an iron-chromium-aluminium alloy.

Suitable microporous thermal and electrical insulation materials are well-known in the art, for example as described in GB-A-1 580 909, a typical composition being:

| | |
|---|---|
| Microporous pyrogenic silica | 49 to 97% by weight |
| Ceramic fibre reinforcement | 0.5 to 20% by weight |
| Opacifier | 2 to 50% by weight |
| Alumina | up to 12% by weight |

The proportion of alumina is preferably in the range from 0.5 to 12 percent by weight.

The invention is now described by way of example with reference to the accompanying drawings in which:

BRIEF DESCRIPTION OF THE DRAWINGS

FIG. 5 is a cross-sectional view of the radiant electric heater of FIG. 4; and FIG. 6 shows part of FIG. 5 to a larger scale.

DESCRIPTION OF PREFERRED EMBODIMENTS

A radiant electric heater is constructed comprising a metal dish 1 containing a base layer 2 of compacted microporous thermal and electrical insulation material, having a substantially planar surface and having a composition such as that described in GB-A-1 580 909.

Figure 1:
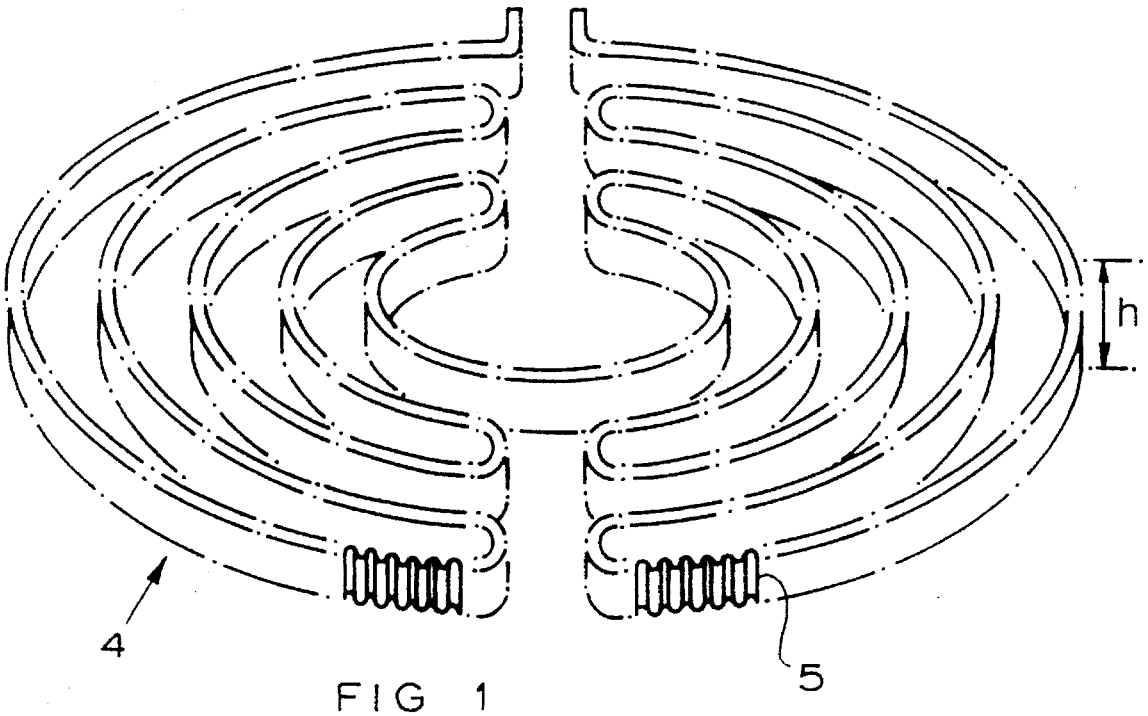
FIG. 1 is a perspective view of a heating element comprising an electrically conductive strip, for use in a radiant electric heater according to the present invention.

A heating element 4 is provided from an elongate strip 5 of a metal or metal alloy, such as an iron-chromium-aluminium alloy, having a thickness of, for example, 0.05 to 0.2 mm and a height h of, for example, 3 to 6 mm. The strip 5 itself is provided of corrugated form (sometimes also known as sinuous, serpentine or convoluted form) and is bent into a desired shape for the heating element, as shown in FIG. 1, using techniques well known in the art. It should be noted, however, that the dimensions of thickness of the strip quoted above are for the strip before making into corrugated form.

Figure 3:
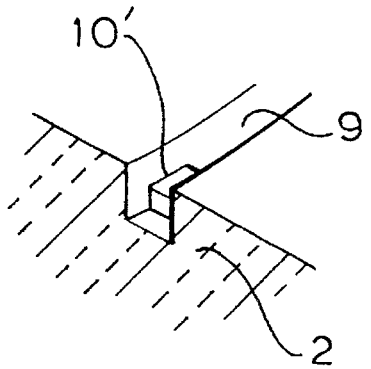
FIG. 3 is a partial perspective view of a modification of the radiant electric heater base shown in FIG. 2.
Figure 2:
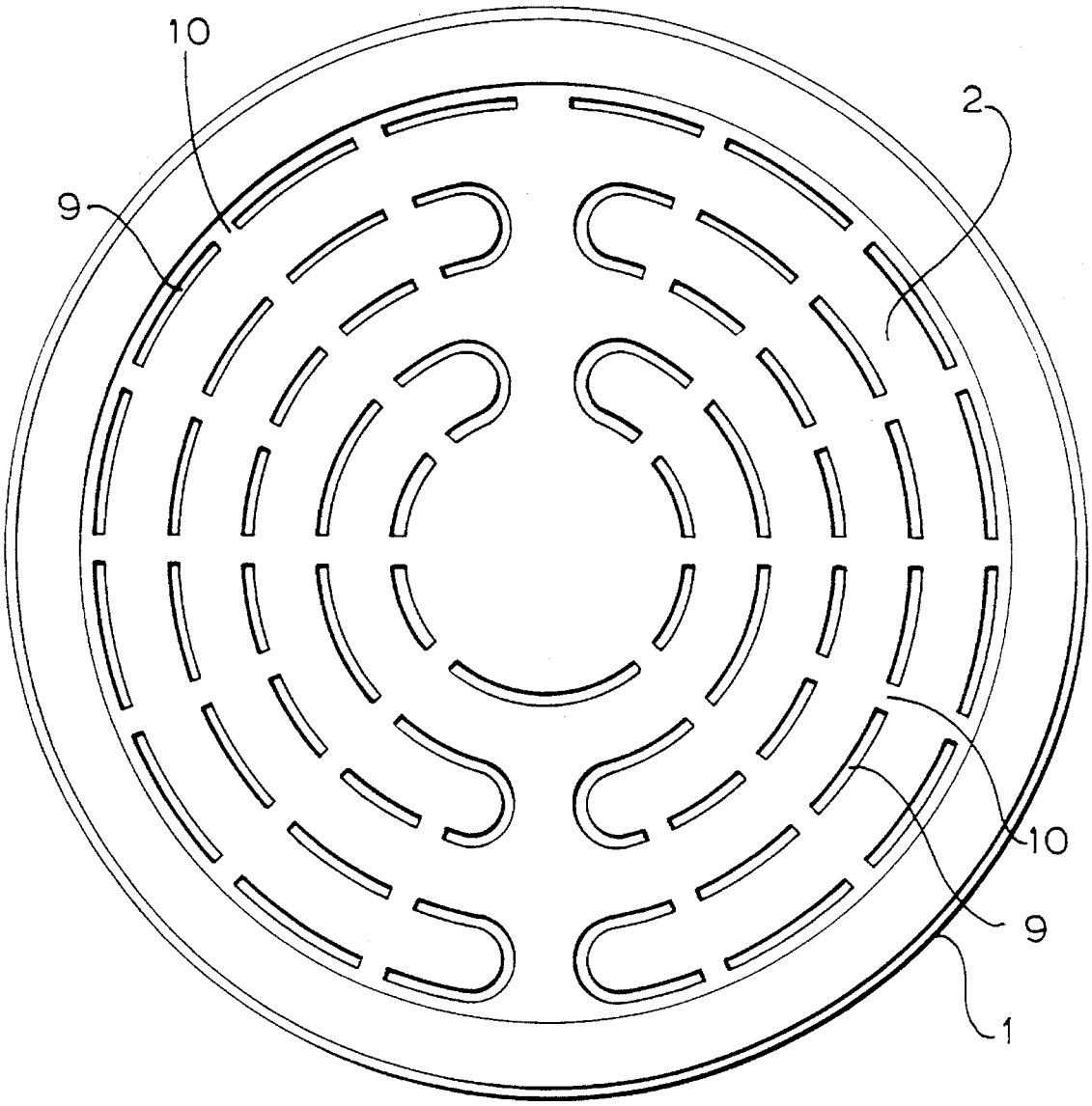
FIG. 2 is a plan view of a base of a radiant electric heater according to the present invention, for receiving the heating element of FIG. 1.
Figure 4:
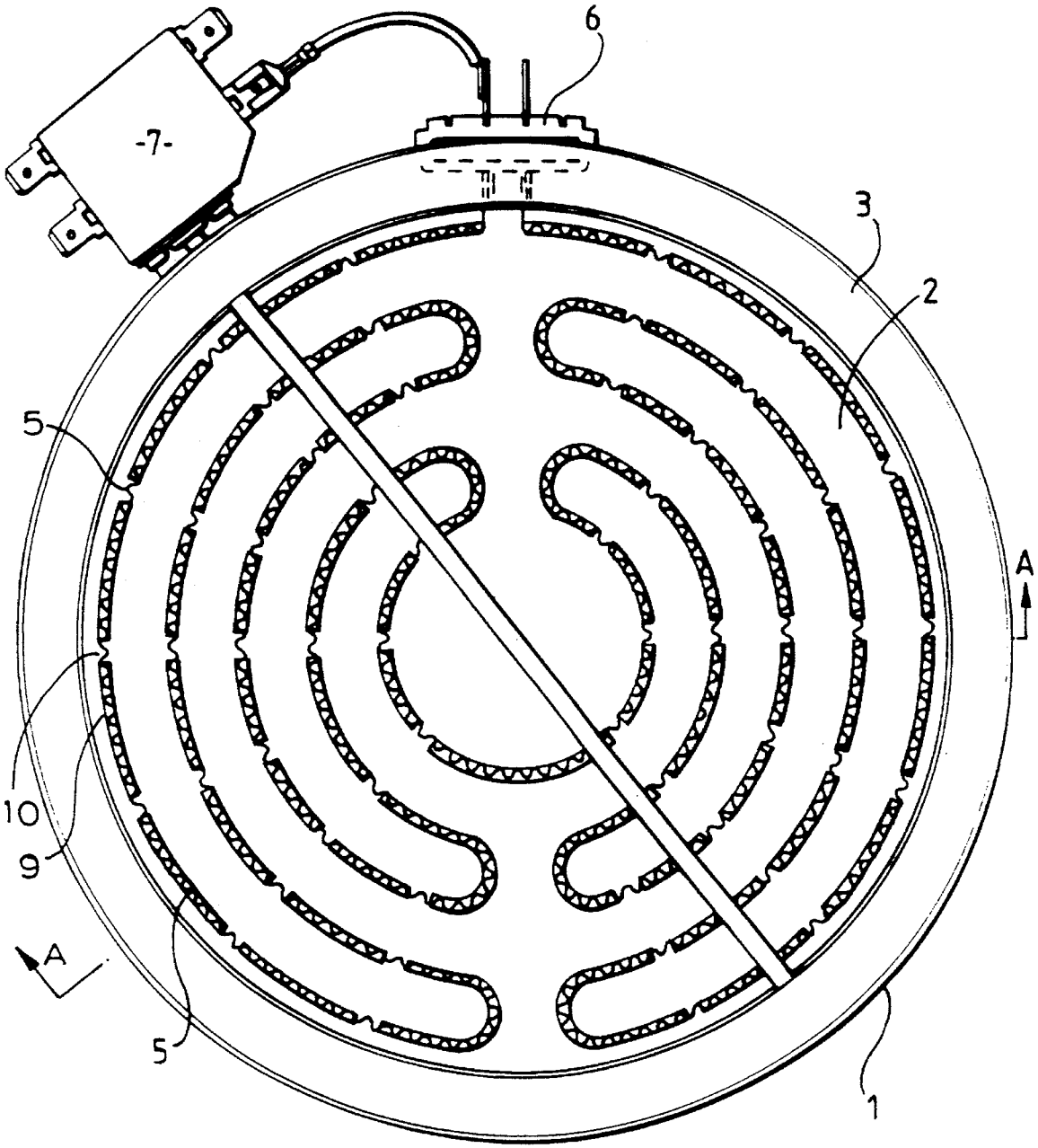
FIG. 4 is a plan view of a radiant electric heater according to the present invention, comprising the components of FIGS. 1 and 2.

The surface of the base 2 of microporous insulation material is provided with grooves 9 in a pattern corresponding to the shape of the heating element 4. The grooves 9 are arranged to be at least as wide as the overall width of the corrugated conductive strip 5. Transverse webs 10 of the same microporous material as base 2 are provided at spaced-apart locations along the grooves 9 and extending from the bottom of the grooves 9. As shown in FIG. 2, the webs 10 are coplanar with the surface of the base 2, but they may alternatively be provided below the surface of the base 2 as illustrated by the webs 10' shown in FIG. 3. The grooves 9 and webs 10 are suitably formed by means of an appropriate moulding tool during compacting of the microporous insulation material into the dish 1 to form the base 2, or may be machined into the surface of the base material after compaction.

The heating element 4 is then located on the base 2 and the heating element strip 5 is urged edgewise into the grooves 9 as illustrated in more detail in FIG. 6. At the same time, the strip 5 is urged into and embedded in the webs 10 to a depth corresponding to at least part of the height h of the strip 5 and becomes secured in these webs.

Preferably the secured strip 5 protrudes from the base 2, for example, by at least 50 per cent of the height h of the strip 5.

Against the side of the dish 1 is located a peripheral wall 3 of thermal insulation material, such as a ceramic fibre material made from aluminosilicate fibres, or alternatively microporous insulation material. A terminal connector 6 is provided for electrically connecting the heating element 4 to an electrical supply, for operation thereof.

A well-known form of thermal cut-out device 7 is provided, extending over the heating element 4, to switch off the heating element in the event of over-heating of the glass-ceramic cooking surface when the heater is installed and operating in a cooking appliance having such a glass-ceramic cooking surface.

I claim:

1. A radiant electric heater comprising a base of microporous thermal and electrical insulation material having a surface with at least one groove formed therein, into which groove is located edgewise an elongate electrically conductive strip of predetermined height to serve as a heating element, the groove including transverse webs of the microporous insulation material spaced apart along the length of the groove and into which webs is embedded the conductive strip so as to secure the conductive strip to the webs.

2. A radiant electric heater according to claim 1, wherein the webs are provided substantially coplanar with that surface of the base in which the groove is provided.

3. A radiant electric heater according to claim 1, wherein the webs are provided below that surface of the base in which the groove is provided.

4. A radiant electric heater according to claim 1, wherein the located conductive strip protrudes from the webs in the base of microporous insulation material such that the strip is not embedded to its full height in the webs.

5. A radiant electric heater according to claim 1, wherein the electrically conductive strip is of corrugated form along its length.

6. A radiant electric heater according to claim 1, wherein the base of microporous insulation material is provided as a compacted layer inside a supporting dish.

7. A radiant electric heater according to claim 1, wherein the base of microporous insulation material has a surface of substantially planar form in which the groove is provided.

8. A radiant electric heater according to claim 1, wherein the strip comprises a metal or a metal alloy.

9. A radiant electric heater according to claim 8, wherein the metal alloy comprises an iron-chromium-aluminium alloy.

* * * * *